US007878501B2

(12) United States Patent
Chino

(10) Patent No.: US 7,878,501 B2
(45) Date of Patent: Feb. 1, 2011

(54) EDGE REGULATING DEVICE, PRINTING MEDIUM CASSETTE, AND PRINTING APPARATUS

(75) Inventor: Hiroki Chino, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/407,045

(22) Filed: Mar. 19, 2009

(65) Prior Publication Data

US 2009/0236796 A1 Sep. 24, 2009

(30) Foreign Application Priority Data

Mar. 21, 2008 (JP) ..... 2008-073070

(51) Int. Cl.
*B65H 1/00* (2006.01)

(52) U.S. Cl. ..... 271/171; 271/145

(58) Field of Classification Search ..... 271/171, 271/145

See application file for complete search history.

(56) References Cited

U.S. PATENT DOCUMENTS 5,632,477 A * 5/1997 Morinaga ..... 271/127
6,926,269 B2 * 8/2005 Ishikuro ..... 271/171
7,464,927 B2 * 12/2008 Ito et al. ..... 271/171
2004/0070138 A1 * 4/2004 Ishikuro ..... 271/171
2005/0133983 A1 * 6/2005 Jacobs et al. ..... 271/145
2006/0222434 A1 * 10/2006 Kitamura et al. ..... 400/624

FOREIGN PATENT DOCUMENTS

JP 11-291653 11/1998
JP 2003-201022 7/2003
JP 2003-300631 10/2003
JP 2006-008351 1/2006

* cited by examiner

*Primary Examiner*—Kaitlin S Joerger
(74) *Attorney, Agent, or Firm*—Workman Nydegger

(57) ABSTRACT

An edge regulating device that regulates edge of a printing medium by an edge guide includes a first holding unit that is able to hold the edge guide with a predetermined pitch along the direction of displacement of the edge guide and a second holding unit that is able to hold the edge guide with a pitch larger than the holding pitch by the first holding unit along the direction of displacement of the edge guide.

8 Claims, 4 Drawing Sheets

EDGE REGULATING DEVICE, PRINTING MEDIUM CASSETTE, AND PRINTING APPARATUS

BACKGROUND

1. Technical Field

The present invention relates to an edge regulating device that regulates edges of printing media by an edge guide. The invention also relates to a printing medium cassette provided with the edge regulating device and a printing apparatus.

2. Related Art

In a printing apparatus represented by facsimile machines or printers, an edge guide that regulates edges of printing papers is provided on a paper cassette for storing the printing papers. The edge guide is provided so as to be displaceable (slidable) in the widthwise direction or the lengthwise direction of the printing papers, and is configured to be held at a desired position using notch structure as disclosed in JP-A-2006-8351.

A number of sawteeth which constitute the notches disclosed in JP-A-2006-8351 are arranged with a small pitch along the direction of displacement of the edge guide so as to accommodate the edge of papers of any given size. The directions of bevels of the sawteeth which constitute the notches are set so that projections on the side of the edge guide which enter the notches do not move easily in the direction away from the paper edge (do not climb over the sawteeth), and so as to move easily in the direction toward the paper edge (so as to be capable of climbing over the sawteeth).

Accordingly, when moving the edge guide toward the paper edges, it is moved easily without performing an operation to release the projections from a number of the notches arranged along the direction of displacement of the edge guide, and after the edge guide is positioned at a position to regulate the paper edges once, the edge guide does not move easily away from the paper edges by a force applied from the papers.

However, in the paper cassette, for example, there is a case in which a configuration to form an inner wall located at a position opposing a distal end of a preset paper bundle into a beveled shape to preliminarily separate the papers using this beveled shape is employed.

In such a case, when the edge guide is abutted forcefully against the paper edges (the edges on the rear end side of the papers in this case), the distal ends of the preset papers might slide upward on the beveled shape, whereby the setting state of the papers might get out of order. Consequently, the beveled shape cannot demonstrate its separating function sufficiently when feeding the papers, so that duplicated feeding might occur.

In other words, since the inner wall opposing the distal ends of the papers is formed into the beveled shape, the feeling of resistance that a user receives from the papers when bringing the edge guide into abutment with the rear ends of the papers is small, so that the edge guide has a property to be moved easily to a position beyond an adequate position.

SUMMARY

An advantage of some aspects of the invention is to provide an edge regulating device that is able to prevent an edge guide from being brought into abutment with paper edges forcefully more than necessary while enabling the edge guide to be held at a given position so as to accommodate the paper edges of any given size.

According to a first aspect of the invention, there is provided an edge regulating device that regulates edge of a printing medium by an edge guide including: a first holding unit that is able to hold the edge guide with a predetermined pitch along the direction of displacement of the edge guide; and a second holding unit that is able to hold the edge guide with a pitch larger than the holding pitch by the first holding unit along the direction of displacement of the edge guide.

In this configuration, the edge guide can be hold at a given position so as to accommodate the edge of the printing medium of any given size by the first holding unit and, simultaneously, a tactile feedback (click touch) is provided to a user who operates the edge guide at a position suitable to the size of the printing medium by the second holding unit.

Accordingly, the user is able to know the position suitable for the size of the printing medium via the change of the operating touch of the edge guide, whereby the edge guide is prevented from being brought into abutment with the edge of the printing medium forcefully more than necessary.

Preferably, the second holding unit is able to hold the edge guide at a position which regulates the edge of the printing medium of at least one standard size.

In this configuration, since the second holding unit is able to hold the edge guide at the position which regulates the edge of the printing medium of at least one standard size, the edge guide is prevented from being pressed strongly against the standard size printing medium which is frequently used.

Preferably, the first holding unit includes a plurality of first recesses arranged with a predetermined pitch along the direction of displacement of the edge guide on a plane of displacement of the edge guide and a first projection that is provided on the edge guide and enters the first recesses, the second holding unit includes a plurality of second recesses arranged at a distance larger than the arrangement pitch of the first recesses along the direction of displacement of the edge guide on the plane of displacement of the edge guide and a second projection that is provided on the edge guide and enters the second recesses, the shapes of the first recesses and the first projection are set to restrain the edge guide from moving in the direction away from the edge of the printing medium and allows the edge guide to move in the direction toward the edge of the printing medium, and the shapes of the second recesses and the second projection are set to restrain the edge guide from moving in the direction toward the edge of the printing medium.

In this configuration, since the first holding unit allows the edge guide to move in the direction toward the edge of the printing medium and restrain the same from moving in the direction away from the edge of the printing medium, when moving the edge guide toward the edge of the printing medium, it can be moved easily without performing an operation to release the first projection from the first recesses arranged along the direction of displacement of the edge guide. After the edge guide is positioned once at a position to regulate the edge of the printing medium, the edge guide is held so as not to move easily away from the edge of the printing medium by a force applied to the edge guide from the printing medium.

Since the second holding unit restrain the edge guide from moving in the direction toward the edge of the printing medium, when the edge guide is moved toward the edge of the printing medium, a strong tactile feedback (click touch) is provided to a user at a position suitable for the size of the printing medium, so that the edge guide is prevented from being brought into abutment with the edge of the printing medium forcefully more than necessary.

Preferably, a fitting and releasing operation of the first projection with respect to the first recesses and a fitting and releasing operation of the second projection with respect to the second recesses are executable independently.

If the first projection and the second projection are displaced synchronously, when the first projection is released from the first recess being fitted, the second projection is released from the second recess simultaneously, so that the tactile feedback (click touch) might not be provided to the user at the position suitable for the size of the printing medium when moving the edge guide toward the edges of the printing media. However, since the fitting and releasing operation of the first projection with respect to the first recesses and the fitting and releasing operation of the second projection with respect to the second recesses are executable independently, disadvantages as described above are prevented.

Preferably, the first holding unit includes a first operating unit that releases the first projection from the first recesses, the second holding unit includes a second operation unit that releases the second projection from the second recesses, the first operating unit and the second operating unit are configured by a single operating member so that the first projection is released from the first recesses and the second projection is released from the second recesses by operating the operating member.

In this configuration, the first projection is released from the first recesses and the second projection is released from the second recesses by operating the single operating member. In other words, since release of the holding state by the first holding unit and release of the holding state by the second holding unit are executable by the single operating member, it is not necessary to perform operation separately and independently, thereby improving ease of operation.

A second aspect of the invention is a printing medium cassette configured to store a plurality of printing media including the edge regulating device according to the first aspect of the invention. In this configuration, the same effects and advantages as described above are achieved in the printing medium cassette.

Preferably, an inner wall opposing a distal end of the stored printing medium forms a beveled shape which forms an opening angle with respect to a stacking direction of the printing media.

When the inner wall at a position opposing the distal ends of the printing media set in the printing medium cassette is formed into a beveled shape, and the beveled shape is used for separating the printing media, if the edge guide is brought into abutment with the rear edges of the printing media forcefully, the distal ends of the preset printing media slide upward on the beveled shape, whereby the beveled shape might not be able to demonstrate the separating function sufficiently when feeding the printing media.

However, with the second holding unit as described above, the tactile feedback (click touch) is provided to the user who operates the edge guide at the position suitable for the size of the printing media, so that the edge guide is prevented from being brought into abutment with the edges of the printing media forcefully more than necessary and the separating function of the bevel shape at a position opposing the distal ends of the printing media is demonstrated sufficiently.

A third aspect of the invention is a printing apparatus configured to perform printing on a printing medium including the edge regulating device according to the first aspect of the invention. In this configuration, the same effects and advantages as described above are achieved in the printing apparatus.

BRIEF DESCRIPTION OF THE DRAWINGS

The invention will be described with reference to the accompanying drawings where like numbers reference like elements.

DESCRIPTION OF EXEMPLARY EMBODIMENTS

Figure 1:
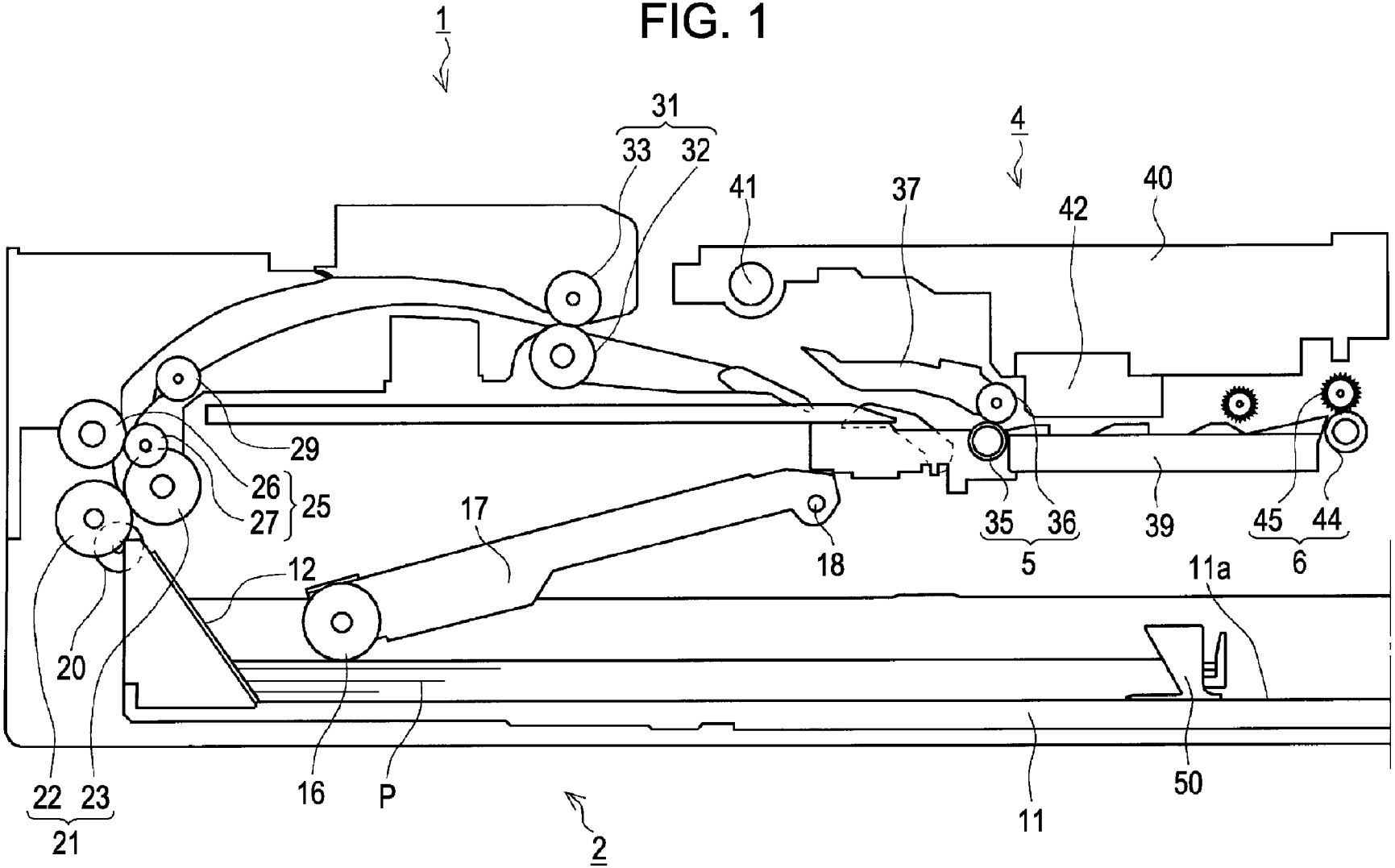
FIG. 1 is a side cross-sectional view of a paper transporting path of an ink jet printer according to the invention.
Figure 2:
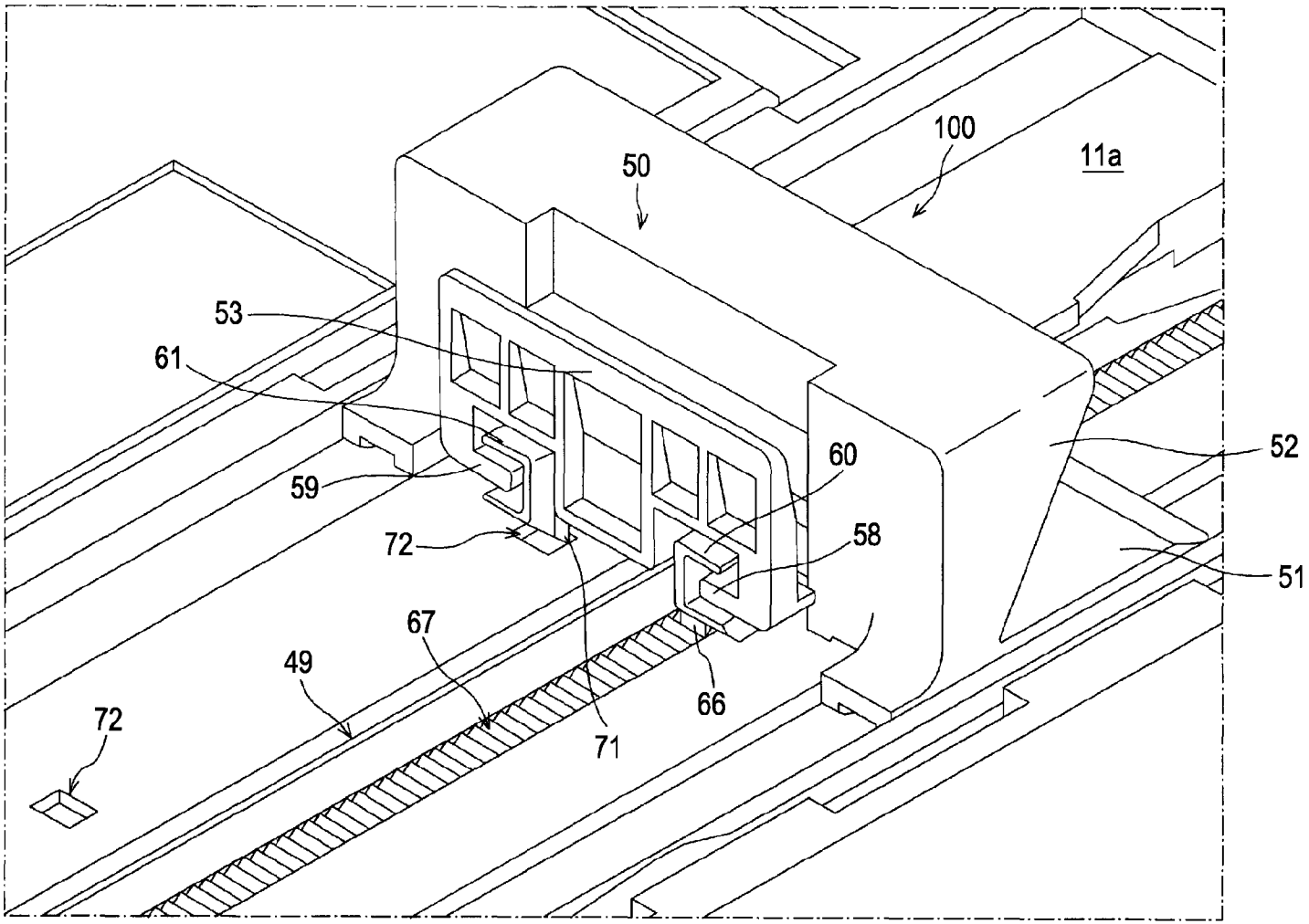
FIG. 2 is a perspective view of an edge regulating device provided in a paper cassette.
Figure 3:
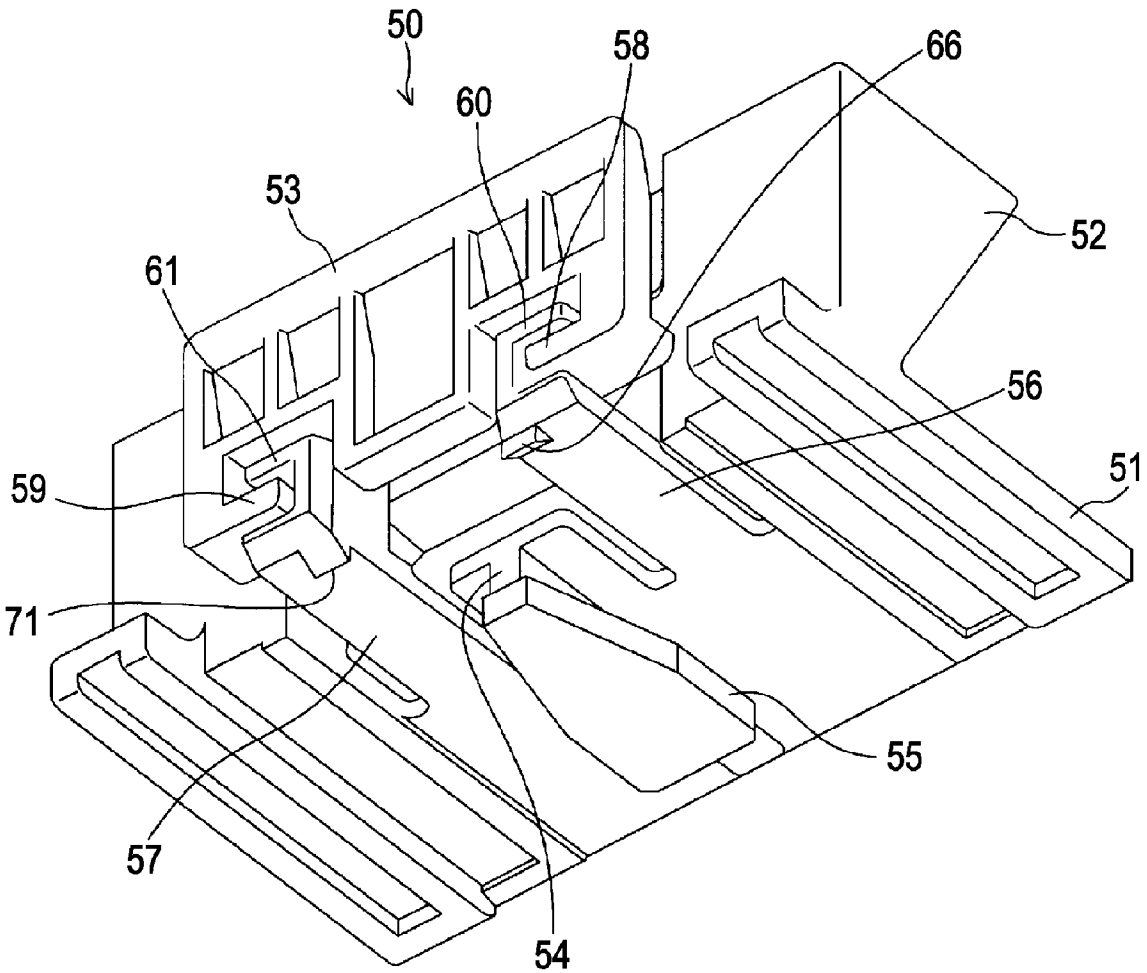
FIG. 3 is a perspective view of an edge guide viewed from below.

Referring now to FIG. 1 to FIG. 4, an embodiment of the invention will be described. FIG. 1 is a side cross-sectional view showing a paper transporting path of an ink jet printer 1 (hereinafter, referred to as "printer") as an embodiment of a "printing apparatus"; FIG. 2 is a perspective view of an edge regulating device 100 (an edge guide 50) provided in a paper cassette 11; FIG. 3 is a perspective view of the edge guide 50 viewed from below; FIG. 4A is a side cross-sectional view of the edge regulating device 100 taken along a position of a first projection 66; and FIG. 4B is a side cross-sectional view of the edge regulating device 100 taken along a position of a second projection 71.

In FIG. 1, although almost all rollers are drawn on the same plane in order to show rollers arranged on the paper transporting path of the printer 1, the positions in the depth direction (the direction from the front to the back of a paper of FIG. 1) do not necessarily match (might match).

Referring now to FIG. 1, a general configuration of the printer 1 will be described briefly. The printer 1 includes a feeding device 2 on the bottom portion of the apparatus, and feeds papers (mainly, cut papers: hereinafter, referred to as "paper P") as an example of the "printing medium" one by one from the feeding device 2, performs a printing job (ink jet printing) in a printing unit 4, and discharges the papers toward a paper discharge stacker, not shown, provided in front of the apparatus (right side in FIG. 1).

Components on the paper transporting path will now be described further in detail.

The feeding device 2 includes the paper cassette 11, a pickup roller 16, a guide roller 20, and a separating unit 21.

The paper cassette 11 in which a plurality of the papers P may be set in a stuck state is mountable and demountable with respect to an apparatus body of the feeding device 2 from the front side of the device, and is provided with the edge guide 50 (described later in detail) that regulates an edge of the papers P in the interior thereof. The edge guide 50 is adapted to regulate rear edges of the papers P as shown in the drawing, and an edge guide that regulates side edges of the papers P is also provided (not shown).

The pickup roller 16 driven by a motor, not shown, to rotate is provided on a rocking member 17 which rocks about a rocker shaft 18, and feeds an uppermost paper P from the paper cassette 11 by coming into contact with the uppermost one of the papers P preset in the paper cassette 11 and rotating.

An inner wall of the paper cassette 11 opposing distal ends of the preset papers P is formed into a beveled shape which forms an opening angle in the stacking direction of the papers P (opened upward), and a separation bevel 12 is arranged on the inner wall. The paper P fed by the rotation of the pickup roller 16 is preliminarily separated from the papers P from the next one onward by its distal end advancing toward the downstream side while being in sliding contact with the separation bevel 12.

The guide roller 20 which is capable of rotating freely is provided on the downstream side of the separation bevel 12, and the separating unit 21 including a separating roller 22 and a drive roller 23 is provided on the downstream side of the guide roller 20. The separating roller 22 is formed of an elastic material on an outer peripheral surface thereof, is provided so as to be capable of coming into press contact with the drive roller 23, and is provided in a state of being applied with a predetermined rotational resistance by a torque limiter mechanism. Therefore, the papers P from the next one onward which are about to be fed in duplexed state are stopped between the separating roller 22 and the drive roller 23, so that the duplex feeding is prevented. The drive roller 23 is driven to rotate in the direction to feed the papers P toward the downstream by a motor, not shown.

Provided downstream side of the separating unit 21 is a first intermediate feeding unit 25 including a drive roller 26 driven to rotate by a motor, not shown, to rotate, and an assist roller 27 driven while nipping the paper P with the drive roller 26, and the paper P is fed further downstream side by the first intermediate feeding unit 25.

The printer 1 includes a curved turn-around path that bends and turns the paper P fed from the paper cassette 11 around so as to proceed the paper in the opposite direction from the direction of travel thereof as shown in the drawing, and a driven roller 29 that alleviates the load of the passage of papers when the paper P passes through the curved turn-around path (in particular, when the rear end of the paper passes therethrough) is provided on the downstream side of the first intermediate feeding unit 25.

Provided on the downstream side of the driven roller 29 is a second intermediate feeding unit 31 including a drive roller 32 driven by a motor, not shown, to rotate, and an assist roller 33 driven to rotate while nipping the paper P with the drive roller 32, and the paper P is fed further to downstream side by the second intermediate feeding unit 31.

The printing unit 4 is provided on the downstream side of the second intermediate feeding unit 31. The printing unit 4 includes a transporting unit 5, a printhead 42, a paper guide front 39, and a discharging unit 6. A paper detecting unit (not shown) that detects the passage of the paper P is also provided in the vicinity of the transporting unit 5 on the upstream side.

The transporting unit 5 includes a transporting drive roller 35 driven by a motor to rotate, and a transporting driven roller 36 supported by a paper guide top 37 via a shaft so as to be in press-contact with and hence driven by the transporting drive roller 35. The paper P reached the transporting unit 5 is precisely fed to the downstream side by being nipped between the transporting drive roller 35 and the transporting driven roller 36 by the rotation of the transporting drive roller 35.

Subsequently, the printhead 42 is provided on the bottom portion of a carriage 40, and the carriage 40 is driven so as to reciprocate in the primary scanning direction by a drive motor, not shown, while being guided by a carriage guide shaft 41 extending in a primary scanning direction (the direction from the front to the back of a paper of FIG. 1). The carriage 40 is so-called an off-carriage type which does not carry an ink cartridge mounted thereof, and an ink cartridge (not shown) is provided independently from the carriage 40, so that ink is supplied from the ink cartridge to the printhead 42 via an ink supply tube (not shown).

The paper guide front 39 is provided at a position opposing the printhead 42, the paper guide front 39 defines the distance between the paper P and the printhead 42. The discharging unit 6 that discharges the printed paper P is provided on the downstream side of the paper guide front 39. The discharging unit 6 includes a discharging drive roller 44 driven by a motor, not shown, to rotate and a discharging driven roller 45 driven to rotate in a state of being in contact with the discharging drive roller 44, and the papers P printed by the printing unit 4 are discharged by the discharging unit 6 to a stacker, not shown, provided on the front side of the device.

The configuration described above is an outline of the printer 1, and referring now to FIG. 2 to FIG. 4, the edge regulating device 100 provided in the paper cassette 11 will be described in detail. The rightward direction in FIG. 4 (the leftward direction in FIG. 1) corresponds to a direction in which the edge guide 50 approaches the rear end edges of the papers (hereinafter, referred to as "direction toward the edge"), and the leftward direction in FIG. 4 (rightward direction in FIG. 1) corresponds to a direction in which the edge guide 50 moves away from the rear end edges of the papers (hereinafter, referred to as "direction away from the edge").

The edge regulating device 100 includes the edge guide 50, first recesses 67 and second recesses 72 provided on a bottom surface 11*a* of the paper cassette 11, and a guide groove 49.

The edge guide 50 is provided so as to be displaceable on the bottom surface 11*a* of the paper cassette 11 as a surface of displacement by sliding in the lengthwise direction (lateral direction in FIG. 4) of the papers P set in the paper cassette 11.

More specifically, the edge guide 50 includes a base unit 51 forming a plane parallel to the bottom surface 11*a* of the paper cassette 11, a regulating block 52 formed into a shape rising upward from the base unit 51 for forming a regulating surface 52*a* that regulates the paper edges, and an operating unit 53 arranged behind the regulating block 52 as an operating unit used for releasing a state of the edge guide 50 held by a first holding unit 65 and a second holding unit 70 described later, and these components are molded integrally by resin molding.

Formed on a surface of the base unit 51 opposing the bottom surface 11*a* of the paper cassette 11 is a guide rail 54 and a locking strip 55 as shown in FIG. 3, and the edge guide 50 is guided along the guide groove 49 by the guide rail 54 entering the guide groove 49 formed on the bottom surface 11*a* of the paper cassette 11 so as to extend in the direction of displacement of the edge guide 50. The locking strip 55 engages the surface on the opposite side from the bottom surface 11*a* to prevent the edge guide 50 from coming off the bottom surface 11*a*.

Subsequently, formed on the bottom surface 11*a* of the paper cassette 11 are the first recesses 67 and the second recesses 72 with the intermediary of the guide groove 49 extending in the direction of displacement of the edge guide 50.

Figure 4A:
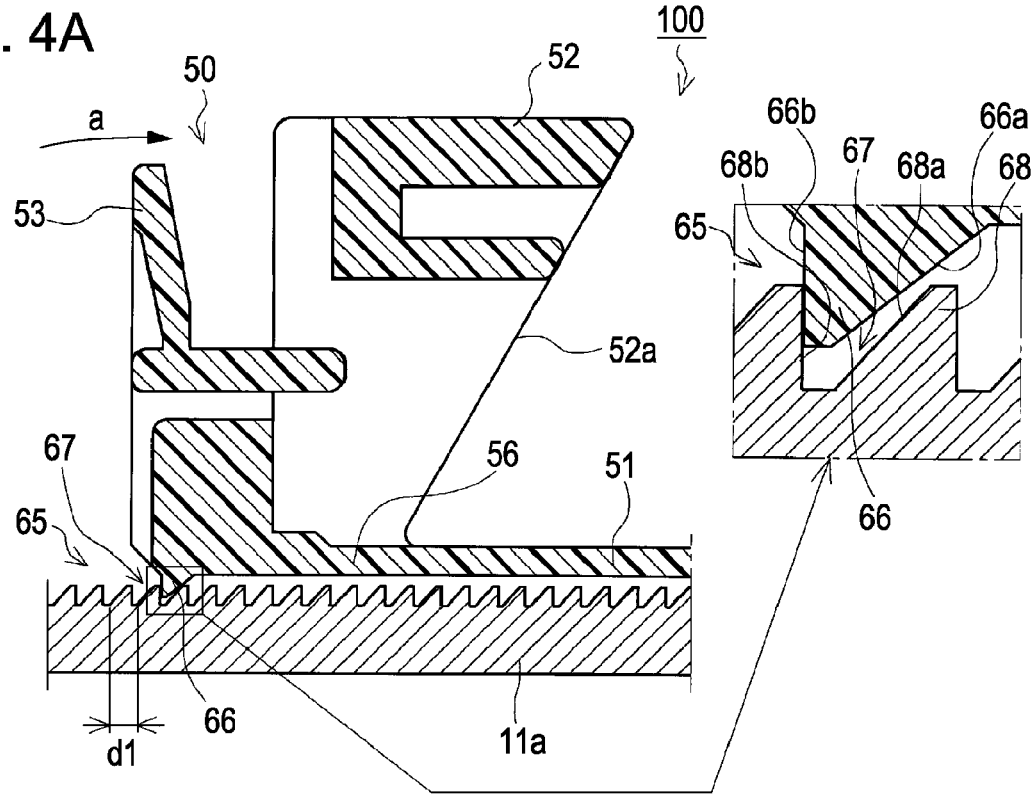
FIG. 4A is a side cross-sectional view of the edge regulating device.

A number of the first recesses 67 are arranged with a predetermined pitch (for example, 1 mm pitch) along the direction of displacement of the edge guide 50 to form notches and, as shown in FIG. 4A, are formed of sawteeth 68 arranged with the predetermined pitch.

In contrast, on the side of the edge guide 50, an elastically deformable first panel portion 56 is formed by providing notched grooves on the base unit 51, and on the distal portion of the first panel portion 56, the first projection 66 projecting toward the first recesses 67 is formed. The first projection 66 is adapted to enter one of the first recesses 67. The first projection 66 is adapted to be fitted to and released from the first recess 67 by the elastic deformation of the first panel portion 56.

The first recess 67 here includes a bevel 68*a* of the sawteeth 68 located in the direction toward the edge and a vertical surface 68*b* of the sawteeth 68 located in the direction away from the edge, and the first projection 66 is formed of a bevel 66*a* on the side of the direction toward the edge and a vertical surface 66*b* on the side of the direction away from the edge.

Therefore, in a state in which the first projection 66 enters the first recess 67, the first projection 66 (that is, the edge guide 50) is allowed to move in the direction toward the edge via the elastic deformation of the first panel portion 56, and is restrained from moving in the direction away from the edge. In the configuration described above, the first holding unit 65 in which the first recesses 67 and the first projection 66 hold the edge guide 50 with a predetermined pitch along the direction of displacement is achieved.

Subsequently, the second recesses 72 provided on the bottom surface 11*a* of the paper cassette 11 on the opposite side of the first recesses 67 with the intermediary of the guide groove 49 are arranged with a pitch larger than the pitch of the first recesses 67 along the direction of displacement of the edge guide 50.

In contrast, on the side of the edge guide 50, an elastically deformable second panel portion 57 is formed by providing notched grooves on the base unit 51 in the same manner as the first panel portion 56, and on the distal portion of the second panel portion 57 is formed with the second projection 71 projecting toward the second recesses 72. The second projection 71 is adapted to enter the second recesses 72. The second projection 71 is adapted to be fitted to and released from the second recesses 72 by the elastic deformation of the second panel portion 57.

Figure 4B:
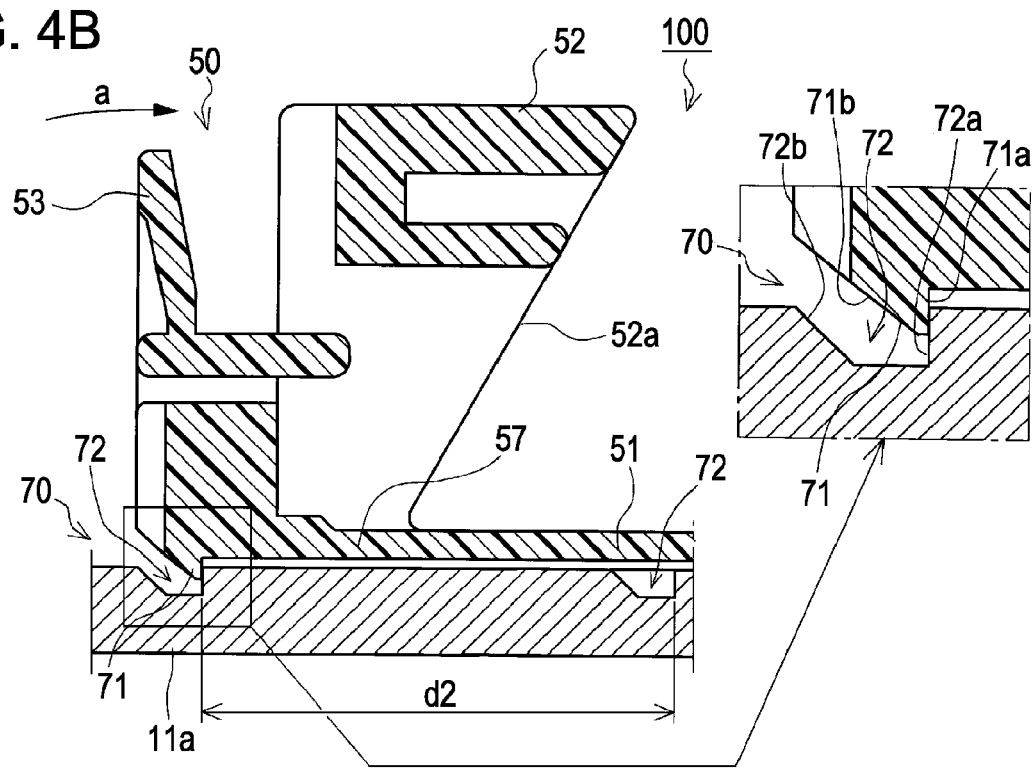
FIG. 4B is a side cross-sectional view of the edge regulating device.

The second recesses 72 here include a vertical surface 72*a* located in the direction toward the edge and a bevel 72*b* located in the direction away from the edge as shown in FIG. 4B, and the second projection 71 is formed of a vertical surface 72*a* on the side of the direction toward the edge and a bevel 71*b* on the side of the direction away from the edge.

Therefore, in a state in which the second projection 71 enters the second recesses 70, the second projection 71 (that is, the edge guide 50) is restrained from moving in the direction toward the edge, and is allowed to move in the direction away from the edge via the elastic deformation of the second panel portion 57. In the configuration described above, the second holding unit 70 in which the second recesses 72 and the second projection 71 hold the edge guide 50 with a pitch larger than the holding pitch by the first holding unit 65 along the direction of displacement is achieved.

The first panel portion 56 is formed with an arm-shaped first engaged portion 60, and the first engaged portion 60 is able to engage an arm-shaped first engaging portion 58 formed on the operating unit 53. The second panel portion 57 is formed with an arm-shaped second engaged portion 61, and the second engaged portion 61 is able to engage an arm-shaped second engaging portion 59 formed on the operating unit 53.

In this configuration, when the operating unit 53 is pressed in the direction indicated by an arrow a in FIG. 4, the first engaged portion 60 and the second engaged portion 61 are lifted upward in association with the elastic deformation of the operating unit 53, and the first panel portion 56 and the second panel portion 57 are elastically deformed, whereby the first projection 66 is released from the first recesses 67, and the second projection 71 is released from the second recesses 72. In other words, the holding state of the edge guide 50 by the first holding unit 65 and the holding state of the edge guide 50 by the second holding unit 70 are both released by operating the operating unit 53.

In the edge regulating device 100 configured as described above, the edge guide 50 can be held at a given position so as to accommodate the edges of papers of any given size by the first holding unit 65. In particular, when moving the edge guide 50 toward the paper edges, it can be moved easily without performing the operation to release the first projection 66 from a number of the first recesses 67 arranged along the direction of displacement of the edge guide 50. After the edge guide 50 is positioned at a position to regulate the paper edges once, the edge guide 50 is held so as not to move easily away from the paper edges by a force applied from the paper.

Then, the second recesses 72 which constitute the second holding unit 70 are arranged with a distance larger than the arrangement pitch of the first recesses 67 and, in this embodiment specifically, they are arranged so as to position the edge guide 50 at an adequate position which regulates the rear edges of the papers of standard sizes (for example, A4 size, B5 size standardized by JIS standard) which can be set in the paper cassette 11.

Therefore, as regards the rear edges of the papers of the standard sizes, a tactile feedback (click touch) is generated at an optimal position for regulating the rear edges by moving the edge guide 50 in the direction toward the edge. Therefore, the edge guide 50 is prevented from being brought into abutment with the rear edges of the papers forcefully more than necessary.

In particular, the separation bevel 12 is provided on the paper cassette 11 at a position opposing the distal end of the paper bundle to be set. Therefore, when the edge guide 50 is brought into abutment against the rear edges of the paper forcefully, the distal end of the preset papers might slide upward on the separation bevel 12, whereby the separation bevel 12 might not be able to demonstrate the separating function sufficiently when feeding the papers. However, as described above, since the click touch is generated in the edge guide 50 at a position suitable for the rear edges of the papers by the second holding unit 70, occurrence of malfunctions as described above is prevented.

The first projection 66 which constitutes the first holding unit 65 and the second projection 71 which constitutes the second holding unit 70 are both able to be displaced independently as is clear from FIG. 3, that is, an fitting and releasing operation of the first projection 66 with respect to the first recesses 67 and an fitting and releasing operation of the second projection 71 with respect to the second recesses 72 are executable independently.

If the first projection 66 and the second projection 71 perform the fitting and releasing operation synchronously when the edge guide 50 is displaced in the direction toward the edge, the second projection 71 comes apart from the second recesses 72 simultaneously when the first projection 66 is released from the first recess 67 being fitted and climbs over the sawteeth 68, so that the tactile feedback (click touch) might not be provided to a user at a position suitable for the rear edges of the papers of the standard size.

However, as describe above, since the fitting and releasing operation of the first projection 66 with respect to the first recesses 67 and the fitting and releasing operation of the second projection 71 with respect to the second recesses 72 are executable independently, the tactile feedback (click touch) is provided to the user reliably at a position suitable of the rear edges of the standard size papers.

What is claimed is:

1. An edge regulating device that regulates edge of a printing medium by an edge guide comprising:

a first holding unit that is able to hold the edge guide with a predetermined pitch along the direction of displacement of the edge guide;

a second holding unit that is able to hold the edge guide with a pitch larger than the holding pitch by the first holding unit along the direction of displacement of the edge guide;

an operating unit engaged with the first holding unit and the second holding unit, and which may be elastically deformed between a holding state and a released state;

wherein elastically deforming the operating unit from the holding state to the released state causes the operating unit to simultaneously apply a pressure to both the first holding unit and second holding unit so that both the first holding unit and the second holding unit are released at the same time.

2. The edge regulating device according to claim 1, wherein the second holding unit is able to hold the edge guide at a position which regulates the edge of the printing medium of at least one standard size.

3. The edge regulating device according to claim 1, wherein the first holding unit includes a plurality of first recesses arranged with a predetermined pitch along the direction of displacement of the edge guide on a plane of displacement of the edge guide and a first projection that is provided on the edge guide and enters the first recesses, the second holding unit includes a plurality of second recesses arranged at a distance larger than the arrangement pitch of the first recesses along the direction of displacement of the edge guide on the plane of displacement of the edge guide and a second projection that is provided on the edge guide and enters the second recesses, the shapes of the first recesses and the first projection are set to restrain the edge guide from moving in the direction away from the edge of the printing medium and allows the edge guide to move in the direction toward the edge of the printing medium, and the shapes of the second recesses and the second projection are set to restrain the edge guide from moving in the direction toward the edge of the printing medium.

4. The edge regulating device according to claim 3, wherein a fitting and releasing operation of the first projection with respect to the first recesses and a fitting and releasing operation of the second projection with respect to the second recesses are executable independently.

5. The edge regulating device according to claim 3, wherein the first holding unit includes a first operating unit that releases the first projection from the first recesses, the second holding unit includes a second operation unit that releases the second projection from the second recesses, and the first operating unit and the second operating unit are configured by a single operating member so that the first projection is released from the first recesses and the second projection is released from the second recesses by operating the operating member.

6. A printing medium cassette configured to store a plurality of printing media includes the edge regulating device according to claim 1.

7. The printing medium cassette according to claim 6, wherein an inner wall opposing a distal end of the stored printing medium forms a beveled shape which forms an opening angle with respect to a stacking direction of the printing media.

8. A printing apparatus configured to perform printing on a printing medium includes the edge regulating device according to claim 1.

* * * * *